US008672037B2

(12) United States Patent
Schuurman et al.

(10) Patent No.: US 8,672,037 B2
(45) Date of Patent: Mar. 18, 2014

(54) PLUG REMOVAL AND SETTING SYSTEM

(75) Inventors: Rene Schuurman, Kellyville, OK (US); Andrea Sbordone, Rio do Janeiro (BR)

(73) Assignee: Schlumberger Technology Corporation, Sugar Land, TX (US)

( * ) Notice: Subject to any disclaimer, the term of this patent is extended or adjusted under 35 U.S.C. 154(b) by 304 days.

(21) Appl. No.: 13/026,416

(22) Filed: Feb. 14, 2011

(65) Prior Publication Data

US 2012/0037374 A1 Feb. 16, 2012

Related U.S. Application Data

(63) Continuation-in-part of application No. PCT/US2009/051963, filed on Jul. 28, 2009.

(60) Provisional application No. 61/088,723, filed on Aug. 13, 2008.

(51) Int. Cl.
*E21B 33/035* (2006.01)
*E21B 33/12* (2006.01)

(52) U.S. Cl.
USPC ..... 166/340; 166/351; 166/38; 166/181

(58) Field of Classification Search
USPC ..... 166/338–341, 351, 352, 365, 368, 166/377–380, 386, 77.1, 77.2, 85.1, 85.3, 166/85.4, 181; 137/315.02; 251/1.1–1.3; 405/183.5
See application file for complete search history.

(56) References Cited

U.S. PATENT DOCUMENTS 3,055,429 A * 9/1962 Kenneday et al. ..... 166/368
3,093,996 A * 6/1963 Jones ..... 73/46
3,556,209 A * 1/1971 Reistle et al. ..... 166/352
3,602,303 A * 8/1971 Blenkarn et al. ..... 166/360
3,872,713 A * 3/1975 Ilfrey et al. ..... 73/40.5 R
4,554,976 A * 11/1985 Hynes et al. ..... 166/341
4,869,324 A * 9/1989 Holder ..... 166/387

(Continued)

FOREIGN PATENT DOCUMENTS

WO 20050103442 11/2005
WO 20060061645 6/2006

(Continued)

OTHER PUBLICATIONS

International Search Report for the equivalent PCT patent application No. PCT/US20091051963 issued on Mar. 24, 2011.

*Primary Examiner* — Matthew Buck

(74) *Attorney, Agent, or Firm* — Stephanie Chi; Jody DeStefanis

(57) ABSTRACT

A method for removing a plug from and setting a plug into a subsea installation is provided. The method for removing the plug includes the steps of deploying an intervention package having at least one valve, pipe rams, and a lubricator into a subsea environment and latching the intervention package to the subsea installation. The method further includes lowering a stroking tool into the intervention package by conveyance from a surface facility, and grabbing the stroking tool with the pipe rams that form a part of the intervention package. Once the stroking tool is held by the pipe rams, the method further includes activating the stroking tool to stroke in an upwards or downwards direction to remove the plug positioned in the subsea installation. Once the plug has been removed by the stroking tool, the method further includes pulling the stroking tool out of the intervention package and retrieving the stroking tool and plug at surface.

2 Claims, 7 Drawing Sheets

(56) References Cited

U.S. PATENT DOCUMENTS

| | | | | | |
|---|---|---|---|---|---|
| 4,905,763 | A * | 3/1990 | Sauer et al. | 166/336 |
| 4,940,095 | A * | 7/1990 | Newman | 166/378 |
| 5,029,642 | A * | 7/1991 | Crawford | 166/72 |
| 5,180,012 | A * | 1/1993 | Crawford | 166/301 |
| 5,343,956 | A * | 9/1994 | Coronado | 166/387 |
| 5,791,413 | A * | 8/1998 | Buzinsky | 166/123 |
| 5,833,001 | A * | 11/1998 | Song et al. | 166/287 |
| 5,848,646 | A | 12/1998 | Huber et al. | |
| 5,988,277 | A * | 11/1999 | Vick et al. | 166/123 |
| 5,996,697 | A * | 12/1999 | Vick et al. | 166/386 |
| 6,009,941 | A | 1/2000 | Haynes | |
| 6,012,528 | A * | 1/2000 | Van Winkle | 166/339 |
| 6,032,736 | A * | 3/2000 | Williams | 166/250.08 |
| 6,044,690 | A * | 4/2000 | Williams | 73/40.5 R |
| 6,102,120 | A * | 8/2000 | Chen et al. | 166/287 |
| 6,719,059 | B2 * | 4/2004 | Dezen et al. | 166/368 |
| 6,896,063 | B2 * | 5/2005 | Chang et al. | 166/386 |
| 7,121,344 | B2 * | 10/2006 | Fenton et al. | 166/339 |
| 7,159,663 | B2 * | 1/2007 | McGuire et al. | 166/379 |
| 7,207,384 | B2 * | 4/2007 | Dallas et al. | 166/250.08 |
| 7,389,818 | B2 * | 6/2008 | Hoiland | 166/367 |
| 7,431,092 | B2 * | 10/2008 | Haheim et al. | 166/343 |
| 8,028,752 | B2 * | 10/2011 | Richards | 166/339 |
| 8,235,123 | B2 * | 8/2012 | Stokka et al. | 166/357 |
| 8,322,441 | B2 * | 12/2012 | Fenton | 166/368 |
| 2005/0211442 | A1 * | 9/2005 | McGuire et al. | 166/379 |
| 2006/0124314 | A1 | 6/2006 | Haheim et al. | |
| 2007/0034379 | A1 * | 2/2007 | Fenton et al. | 166/368 |
| 2008/0185152 | A1 | 8/2008 | Sbordone et al. | |
| 2008/0185153 | A1 | 8/2008 | Smedstad et al. | |
| 2008/0277122 | A1 * | 11/2008 | Tinnen | 166/339 |
| 2008/0314597 | A1 | 12/2008 | Sbordone et al. | |
| 2009/0236100 | A1 * | 9/2009 | Lawson | 166/339 |

FOREIGN PATENT DOCUMENTS

| | | |
|---|---|---|
| WO | 2006/096069 | 9/2006 |
| WO | 20070067786 | 6/2007 |
| WO | 2008118680 | 10/2008 |
| WO | 2008122577 | 10/2008 |
| WO | 2009053022 | 4/2009 |
| WO | 2010019378 | 2/2010 |

* cited by examiner

PLUG REMOVAL AND SETTING SYSTEM

This invention and application is a continuation-in-part of and claims the benefit of priority to co-pending International Patent Application PCT/US2009/051963, filed on Jul. 28, 2009, which claimed the benefit of priority to U.S. Provisional Application No. 61/088,723, filed on Aug. 13, 2008, the entire contents of each are hereby incorporated herein by reference.

BACKGROUND OF THE INVENTION

1. Field of the Invention

The present invention generally relates to methods and systems for well intervention operations in subsea wells, and more particularly to a system and method for removing and setting crown plugs from a subsea installation, such as a horizontal x-mas tree.

2. Background

In order to perform well intervention operations in subsea wells, it is necessary to gain access to the well either by opening some valves (for the so-called Vertical or Conventional x-mas trees) or by removing some plugs, commonly referred to in the art as crown plugs (for the so-called Horizontal x-mas trees). Removal and installation of these plugs is normally performed by slickline, braided line, wireline or coiled tubing ("CT"). In some cases, the removal or installation of a plug can be difficult, due to presence of corrosion, encrustation, debris, differential pressure across the plug, etc.

The problem of removing and installing crown plugs in horizontal x-mas trees has been investigated by several companies involved in subsea intervention, and several existing issued patents or patent applications exist covering different systems and methods to perform these operations, as follows:

Patent application WO2005/103442 entitled "PLUG SETTING AND RETRIEVING APPARATUS" assigned to EXPRO describes an apparatus for, and a method of, setting a plug in or retrieving a plug from a horizontal x-mas tree. The apparatus of WO2005/103442 comprises a housing with a throughbore adapted to be releasably connected at a first end to a horizontal x-mas tree, the housing including an at least one axially moveable member which also includes an at least one radially moveable element and a tool deployable within the housing throughbore by an elongate support and adapted to be releasably connected to the plug.

Patent application WO2006/061645 entitled "PLUG INSTALLATION AND RETRIEVAL TOOL FOR SUBSEA WELLS" assigned to FMC relates to installing or extracting a plug from a subsea well. A plug retrieval and installation tool of WO2006/061645 comprises a housing that is lowered on a lift line or riser and connected to subsea production equipment such as a tree and wellhead housing in use. In addition, a plug manipulator of WO2006/061645 can be extended to install, or retracted to retrieve, a plug-type barrier, that is detachably mounted to the housing so that it can be retrieved independently of the housing.

Patent application WO2007/067786, entitled "PLUG RETRIEVAL AND DEBRIS REMOVAL TOOL" also assigned to FMC relates to methods and tools for retrieving wire line plugs from subsea wells, which allows debris to be removed from on top of the plugs and riser hydrostatic pressure effects to be overcome. An apparatus adapted for removing a plug from a subsea Christmas tree is disclosed in WO2007/067786 which includes a housing, a distal end of the apparatus that is adapted to engage the plug and a fluid passage formed in the housing for use in directing a stream of fluid toward the plug to remove debris from above the plug.

Issued U.S. Pat. No. 6,719,059 entitled "PLUG INSTALLATION SYSTEM FOR DEEP WATER SUBSEA WELLS" assigned to VETCO GREY, issued patent U.S. Pat. No. 7,121,344, entitled "PLUG INSTALLATION SYSTEM FOR DEEP WATER SUBSEA WELLS" also assigned to assigned to VETCO GREY, and patent application US2007/0034379 entitled "PLUG INSTALLATION SYSTEM FOR DEEP WATER SUBSEA WELLS" describe a plug retrieval and installation tool used with a subsea well having a production tree, a tubing hanger, a passage that extends vertically through the tubing hanger and the tree, and a plug located within a plug profile in the passage within the tubing hanger. The plug retrieval device has a housing and connector that is lowered on a lift line onto the upper end of the tree, wherein the connector, drive mechanism and retrieval member are powered by an ROV.

All these systems and methods are quite complex, require the use of dedicated hardware, and the deployment of heavy and bulky equipment which then needs to be retrieved once the plugs have been removed, thus affecting the overall efficiency of the intervention operations.

SUMMARY OF THE INVENTION

Therefore, there is a need for a method and apparatus (which also may be referred to herein as a "system") that addresses discovered problems with existing systems and methods for removing and setting crown plugs from horizontal x-mas trees. The above and other needs and problems are addressed by the present invention, exemplary embodiments of which are presented in connection with the associated figures. The present invention provides an improved method and system that permits to apply a very high force on the plug, in order to overcome the above mentioned difficulties. The method can be applied with different subsea intervention systems, such as a tensioned riser system, a compliant riser system, a spoolable compliant guide system, a subsea lubricator system, and any other intervention system which includes a subsea intervention package connected above the subsea x-mas tree. The present invention overcomes the drawbacks of the conventional systems and methods, and represents a very efficient and effective method to remove and install crown plugs in horizontal x-mas trees.

In an exemplary aspect, there is provided a method for removing a plug from a subsea installation, such as a horizontal x-mas tree. The method for removing the plug includes the steps of deploying an intervention package having at least one valve, pipe rams, and a lubricator into a subsea environment and latching the intervention package to the subsea installation. The method further includes lowering a stroking tool into the intervention package by conveyance from a surface facility, and grabbing the stroking tool with the pipe rams that form a part of the intervention package. Once the stroking tool is held by the pipe rams, the method further includes activating the stroking tool to stroke in an upwards or downwards direction to remove the plug positioned in the subsea installation. Once the plug has been removed by the stroking tool, the method further includes pulling the stroking tool out of the intervention package and retrieving the stroking tool and plug at surface.

After the step of retrieving the stroking tool and plug at surface, the intervention package may be ready to perform an intervention operation in a subsea well.

In another exemplary aspect, there is provided a method for setting a plug into a subsea installation, such as a horizontal x-mas tree. The method for setting the plug includes the steps of deploying an intervention package having at least one valve, pipe rams, and a lubricator into a subsea environment and latching the intervention package to the subsea installation. The method further includes lowering a stroking tool into the intervention package by conveyance from a surface facility, and grabbing the stroking tool with the pipe rams that form a part of the intervention package. Once the stroking tool is held by the pipe rams, the method further includes activating the stroking tool to stroke in an upwards or downwards direction to set a plug in the subsea installation. Once the plug has been set by the stroking tool, the method further includes pulling the stroking tool out of the intervention package and retrieving the stroking tool at surface.

In all aspects of the disclosure herein, a section of the stroking tool may be dimensioned to be grabbed by the pipe rams. Furthermore, the stroking tool may comprise a stroking piston capable of a linear stroking movement within a housing of the stroking tool, and the stroking tool may further comprise a pulling/setting tool attached to the stroking piston and adapted to engage the plug. In one embodiment, the stroking tool may be lowered into the intervention package with the stroking piston in an extended position, and wherein prior to the step of grabbing the stroking tool with the pipe rams, the method further comprises the step of mating the stroking tool to the plug. However, in another embodiment, the stroking tool may be lowered into the intervention package with the stroking piston in a retracted position, and the step of activating the stroking tool in an upwards or downwards direction may include mating the stroking tool to the plug. Moreover, the intervention package may include a dynamic seal, and the conveyance may be wireline, slickline, or coiled tubing. The subsea environment as referred to herein may be open water, a riser, a spoolable compliant guide or a flexible riser.

Still other aspects, features, and advantages of the present invention are readily apparent from the entire description thereof, including the figures, which illustrate a number of exemplary embodiments and implementations. The present invention is also capable of other and different embodiments, and its several details can be modified in various respects, all without departing from the spirit and scope of the present invention. Accordingly, the drawings and descriptions are to be regarded as illustrative in nature, and not as restrictive.

BRIEF DESCRIPTION OF THE DRAWINGS

The embodiments of the present invention are illustrated by way of example, and not by way of limitation, in the figures of the accompanying drawings and in which like reference numerals refer to similar elements and in which.

DETAILED DESCRIPTION

Figure 1:
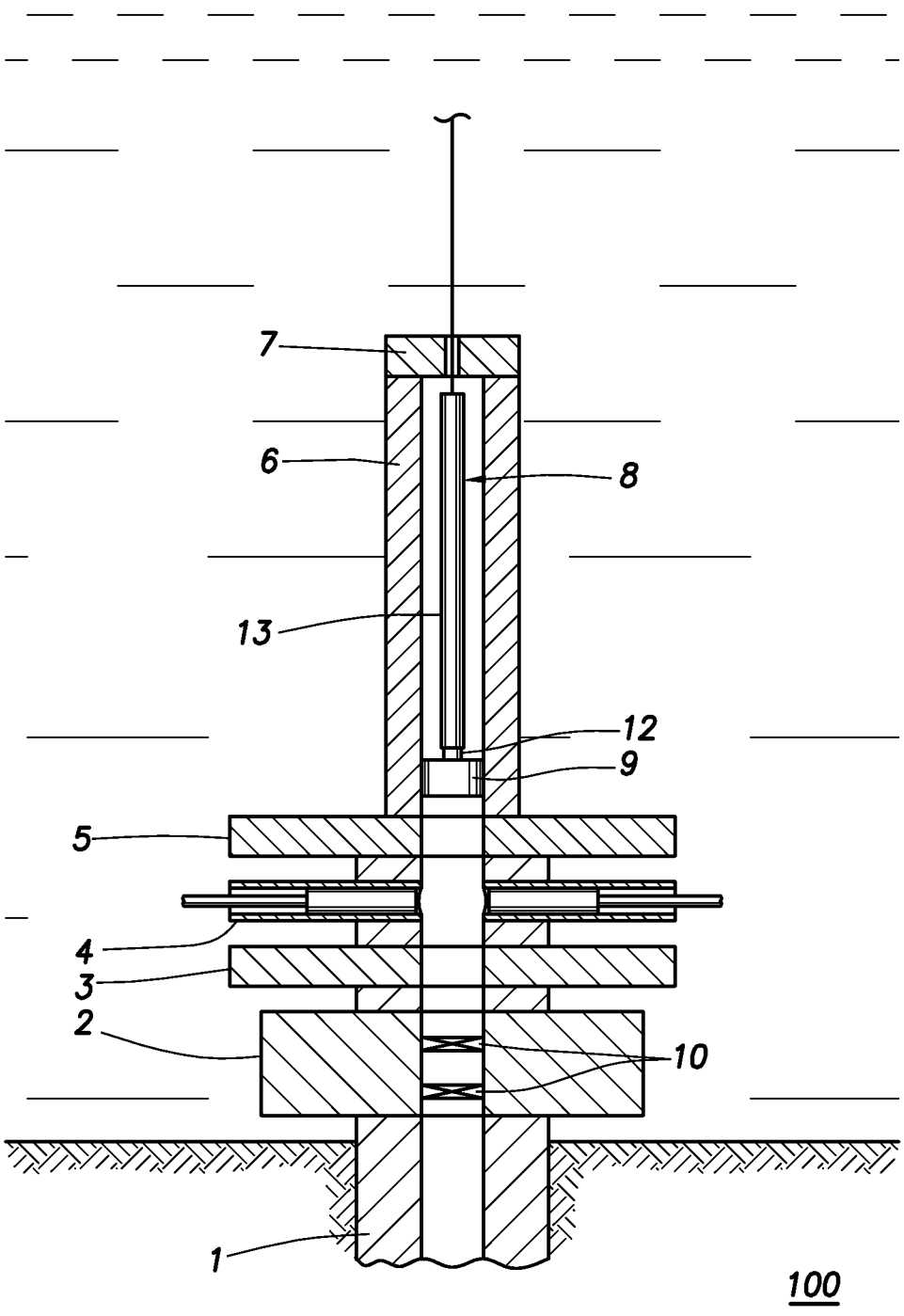
FIGS. 1-7 illustrate an exemplary method to remove a crown plug from and/or set a crown plug into a horizontal x-mas tree, according to exemplary aspects of the present invention.

Various embodiments and aspects of the invention will now be described in detail with reference to the accompanying figures. The terminology and phraseology used herein is solely used for descriptive purposes and should not be construed as limiting in scope. Language such as "including," "comprising," "having," "containing," or "involving," and variations thereof, is intended to be broad and encompass the subject matter listed thereafter, equivalents, and additional subject matter not recited.

Referring now to the drawings, wherein like reference numerals designate identical or corresponding parts throughout the several views, and more particularly to FIGS. 1-7 thereof, there are illustrated an exemplary method and system to remove a crown plug from a horizontal x-mas tree, according to exemplary aspects of the present invention.

With reference to FIG. 1, the following main components of the system can be identified:

1. Subsea well
2. Subsea x-mas tree
3. Valve/BOP
4. Pipe Rams
5. Valve/BOP
6. Lubricator
7. Dynamic Seal
8. Stroking Tool
9. Pulling/Setting tool
10. Crown Plugs The group of 3, 4, 5, 6, and 7 will be referred to herein as "intervention package".

The group of 3, 4, 5 is a representation of one possible configuration of the group of valves that can be used for subsea well intervention, with or without a riser. In the configuration shown, the system includes a lower shear and seal valve or BOP 3, a set of pipe rams 4, which could be Coiled Tubing (CT) pipe rams, and an upper shear and seal valve or BOP 5. The person skilled in the art will recognize that different configurations of the system might exist, where the valves, BOPs and pipe rams are distributed in a different way, or where more valves, BOPs or pipe rams are present, or where only some of the shown components are present. In an exemplary aspect thereof, the present invention includes a set of pipe rams 4, which can grab the stroking tool to counteract the stroking force applied to pull or set the plug 10.

It should be noted that only the components relevant to the disclosure are shown in the figures, and that many other components normally part of a subsea intervention system are not shown for simplicity. For example, the actuation of valves/BOPs 3 and 5 to gain access to the subsea x-mas tree and to seal the well after the removal of the plug is not shown. Similarly, many other operations may not be shown in the figures and described in the present disclosure, for example the sequence to flush the content of the lubricator, to perform a pressure test of the system, to equalize the lubricator pressure to the well pressure, to equalize the pressure above and below the plug to be removed, to apply pressure below the plug to help the removal of the plug, to apply pressure above the plug to help with the installation process, to remove or install the dynamic seal at the top of the lubricator, to retrieve/introduce the toolstring from/in the lubricator, since these operations are well known to the person skilled in the art of subsea intervention and not relevant to disclosure hereof.

Pipe Rams 4 may be a set of standard CT pipe rams used to seal around CT, or could be any other equivalent system which could provide a grabbing force on the stroking tool. In one configuration of the invention, the pipe rams could be already present in the intervention package and dimensioned for the size of CT being used, and the stroking tool could have a section properly dimensioned to be effectively grabbed by these rams. This configuration would provide the grabbing functionality to remove the plugs without additional hardware from what is needed for CT operations.

Lubricator 6 and dynamic seal 7 are components well known to the person skilled in the art of subsea intervention, and will not be described in detail. There main functionality is to provide a pressure tight envelope to allow the introduction and retrieval of the stroking tool into the x-mas tree, while sealing the pressure and fluids coming from the well. They also prevent the entrance of sea water into the tree and well, which could lead to the formation of hydrates.

It should be noted that instead of the lubricator 6 and dynamic seal 7, there may be a riser attached on top of valves 3 and 5.

Stroking tool 8 could be an electrically powered stroking tool. The tool would provide a linear stroking movement, with enough force to set or unset the plug in the x-mas tree. The stroking tool 8 may comprise a stroking piston 12 which can move in and out of a housing 13. At the bottom of the stroking piston 12 is attached the pulling/setting tool 9 which engages with the plug, and which is a standard component used to set and retrieve plugs on slickline. The pulling/setting tool 9 includes the system to engage the plug and to release itself from the plug. A preferred embodiment of the stroking tool 8 and pulling/setting tool 9 has a first end that can be attached to the bottom end of the stroking piston 12 and a second end that engages the crown plug. The exact configuration of the pulling/setting tool 9 would depend on the type of crown plug to be set or to be removed. A variety of pulling/setting tools 9 are known in the art for setting and removing crown plugs 10 using slickline. The system described herein would use the same type of pulling/setting tools normally used with slickline, or other type of tools designed or modified to properly set or retrieve a plug by means of a stroking tool.

Preferably, the stroking tool 8 can be conveyed and powered by an electrical cable from surface (wireline) or alternatively can be conveyed by slickline and powered by batteries included in the tool.

In yet another embodiment of the present invention the stroking tool 8 with the pulling 9 attached thereto are conveyed into the horizontal x-mas tree through one of the spoolable guide apparatus, systems and techniques described in published patent applications US20080314597A1, US20080185153A1, US2008185152A1, WO2009053022A2, WO2008118680A1, and WO2008122577A2 all assigned to the same assignee as the present application hereof and each of which are incorporated herein by reference for all purposes allowed under patent practice and to the extent that their disclosure doesn't contradict with the disclosure of the present invention.

Crown plugs 10 are existing plugs normally used to seal the bore of a horizontal x-mas tree, and which needs to be removed from the tree to gain access to the well to perform intervention services.

Operational Sequence: Removing Crown Plug

FIG. 1: shows the stroking tool 8 with the pulling tool 9 attached to it. The toolstring is attached to the chosen conveyance (normally wireline or slickline) and is already inside lubricator 6, and flushing/pressure testing/equalizing has already been performed. Valve/BOP 3 and 5 have been open, and pipe rams 4 have been open as well.

Figure 2:
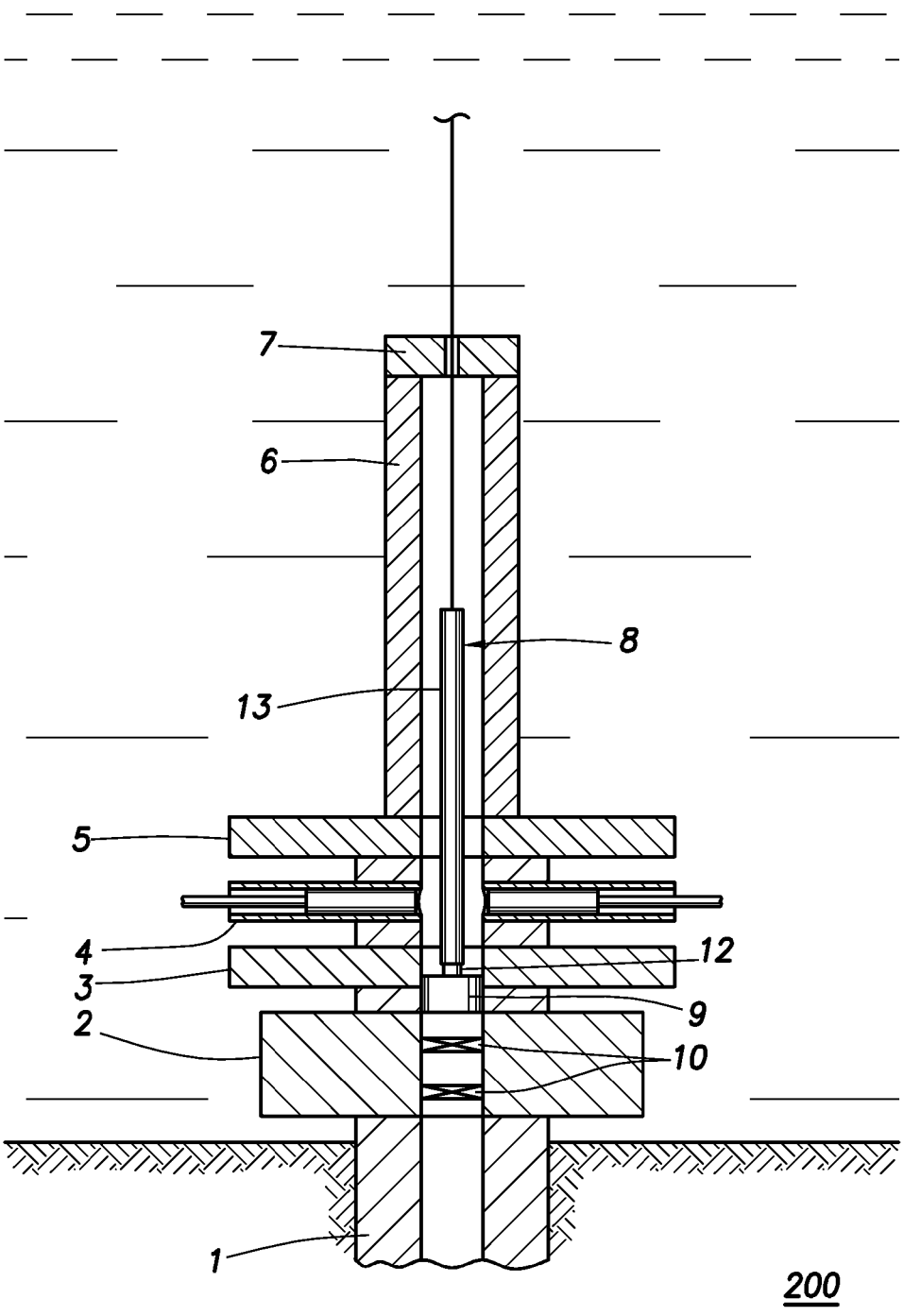

FIG. 2: the toolstring is lowered into the tree and stopped in a position where the pipe rams 4 can grab the stroking tool 8 in an appropriate section.

Figure 3:
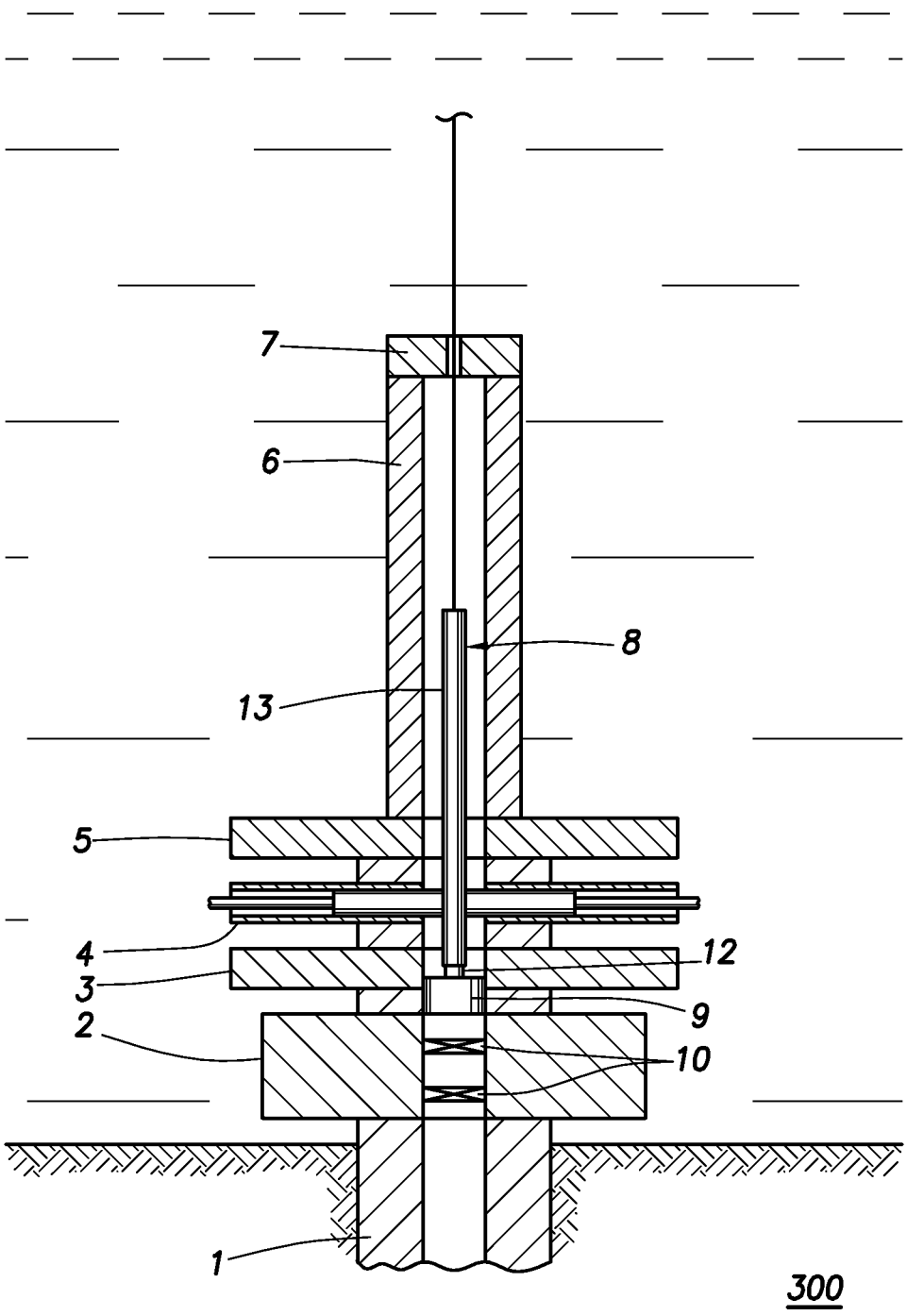

FIG. 3: the pipe rams 4 are activated and grab the stroking tool 8.

Figure 4:
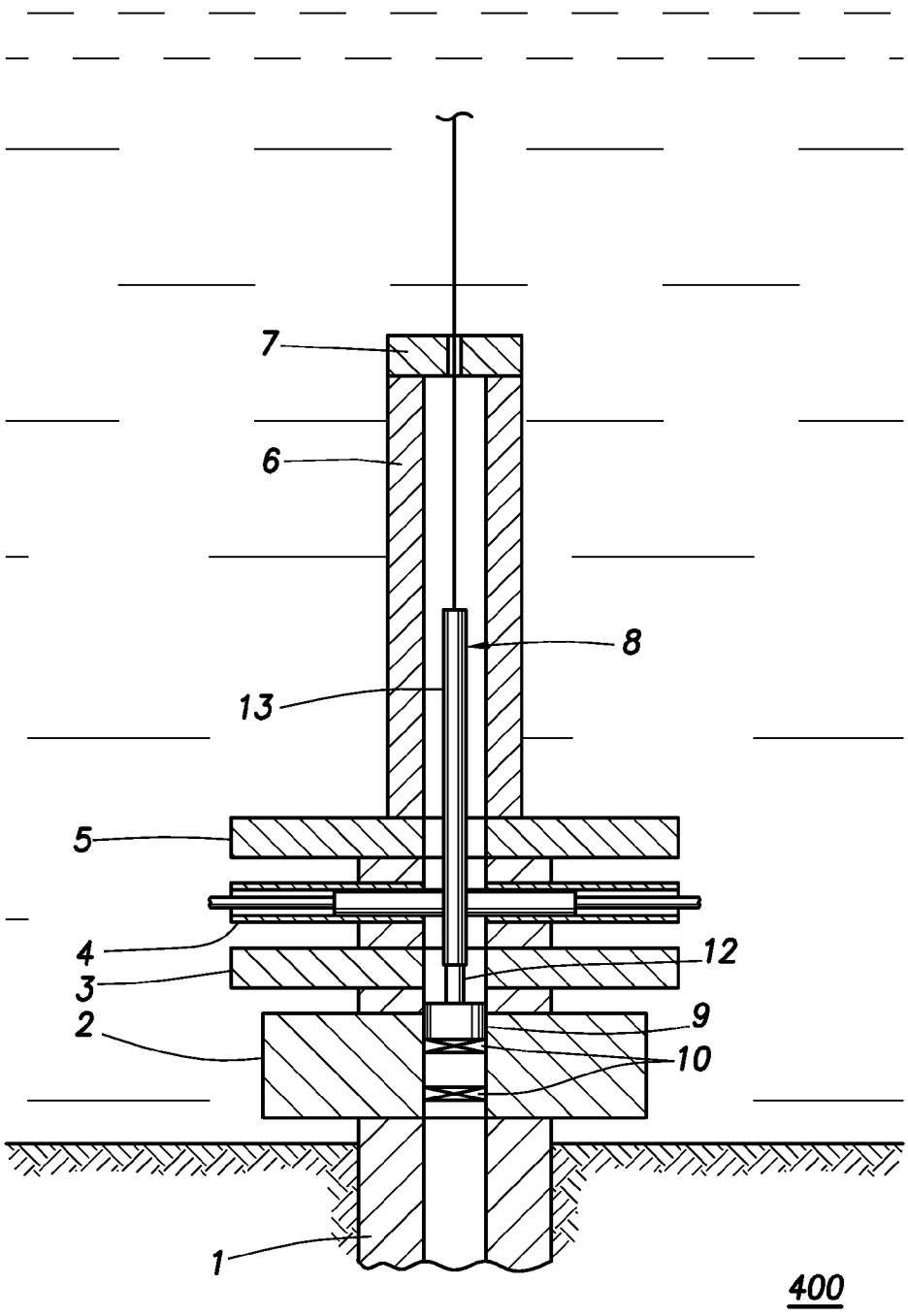

FIG. 4: the stroking tool 8 is extended, until the pulling tool 9 engages and mates with the plug 10.

Figure 5:
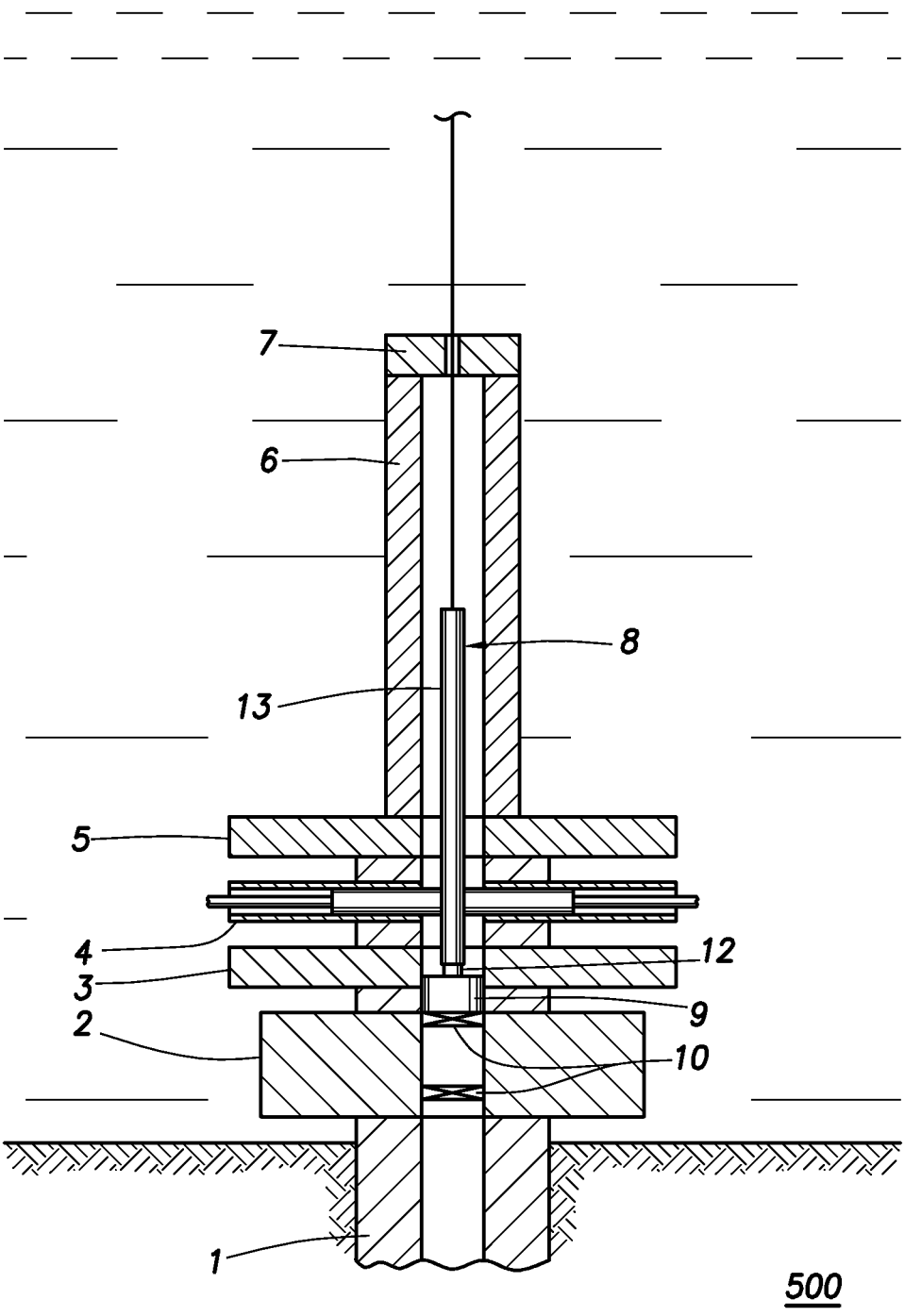

FIG. 5: the stroking mechanism is reversed, applying a strong pulling force on plug 10, until the locking mechanism of the plug is released and the plug becomes unseated. The stroking mechanism continues its upward movement until the plug is unseated and ready to be retrieved.

Figure 6:
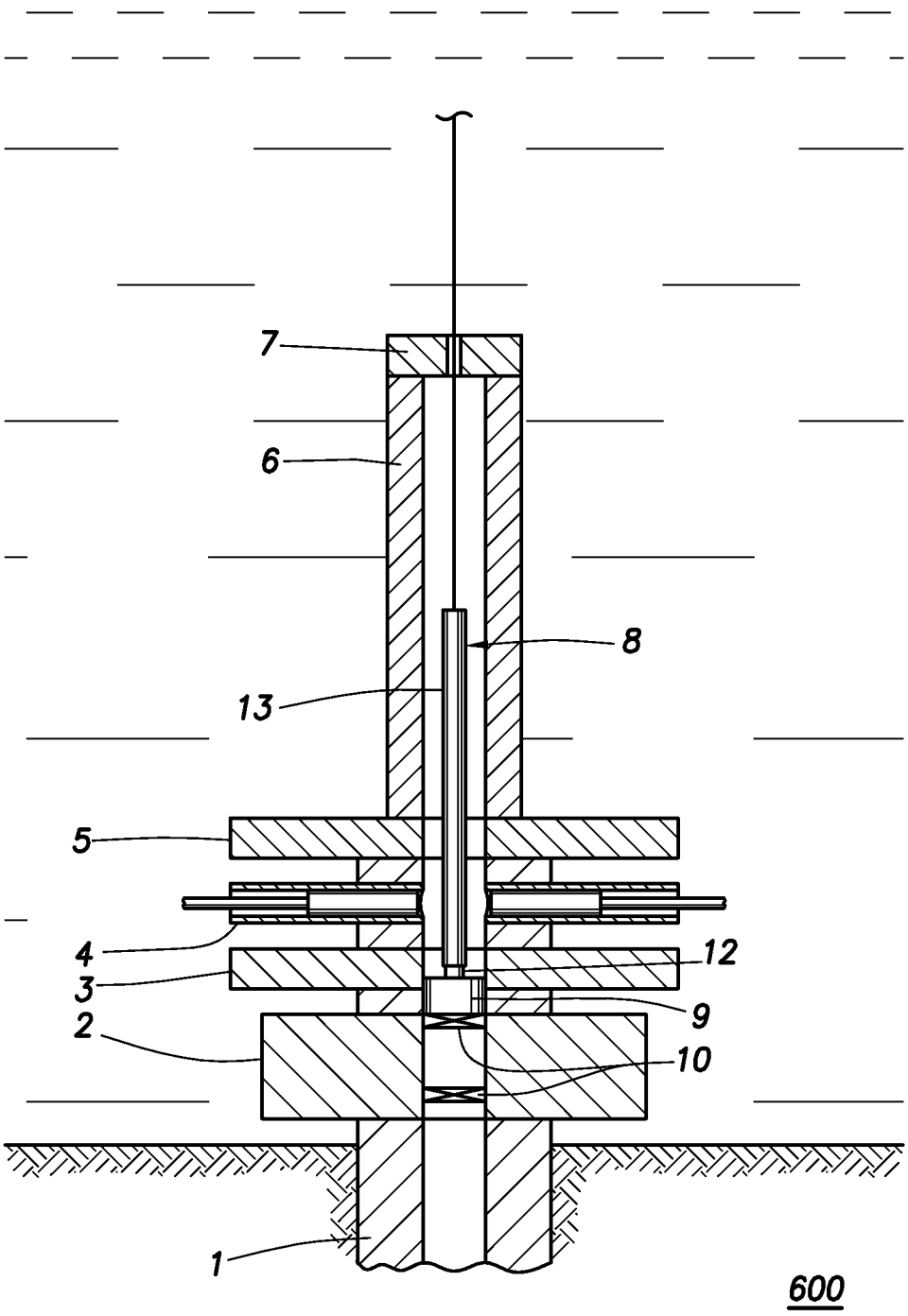

FIG. 6: the pipe rams 4 are retracted, releasing the stroking tool 8.

Figure 7:
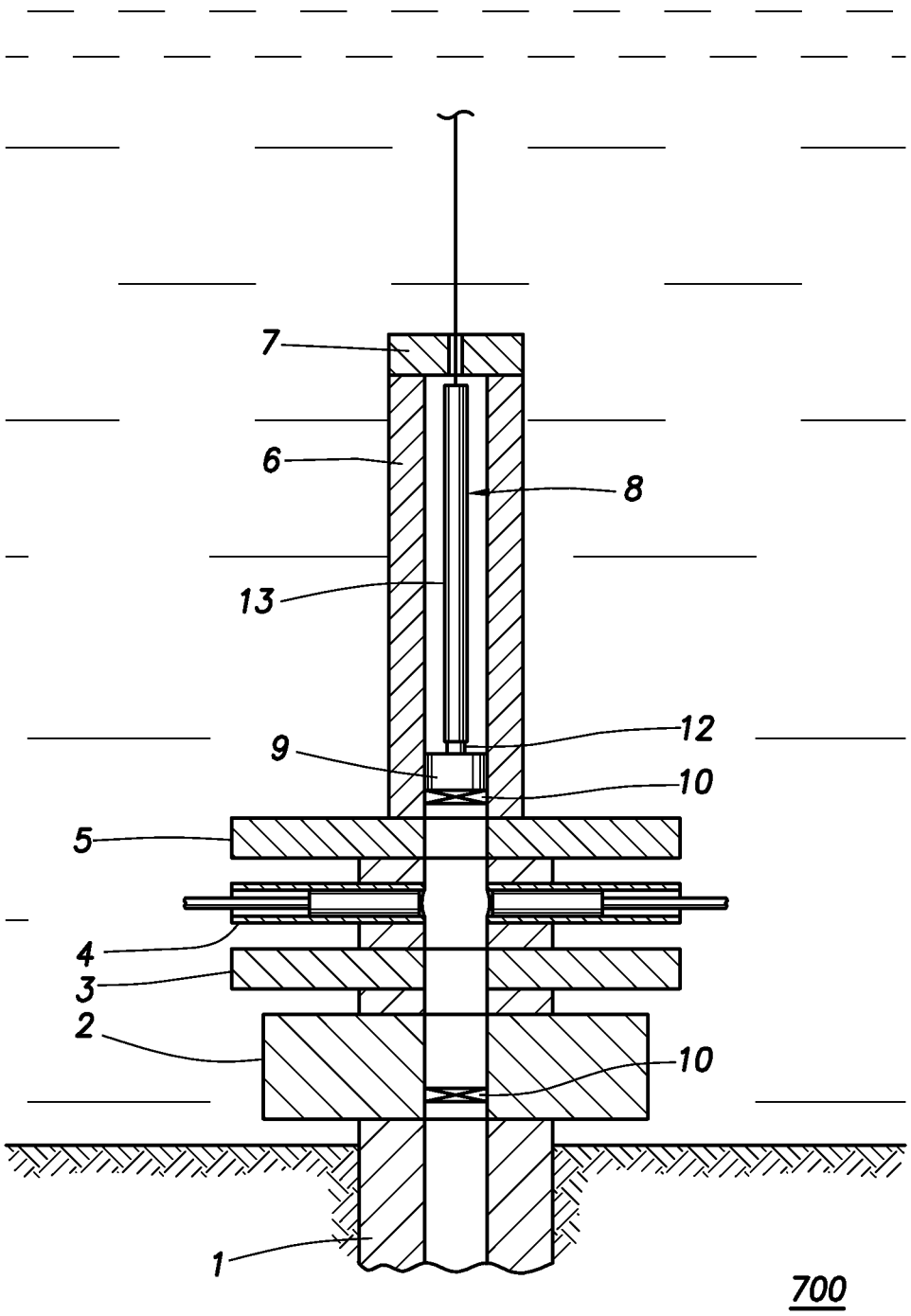

FIG. 7: the stroking tool 8 is pulled up into the lubricator with plug 10 attached to pulling tool 9.

At this point the valves/BOPs 3 and 5 can be closed, and the sequence of operation can continue to retrieve the stroking tool to surface.

An alternative sequence contemplated by the present disclosure, would be:

The stroking tool 8 in extended position is lowered until the pulling tool 9 engages with plug 10.

The pipe rams 4 are activated and grab the stroking tool 8.

The stroking tool 8 is retracted, applying a strong pulling force on plug 10, until the locking mechanism of the plug 10 is released and the plug 10 becomes unseated. The stroking mechanism continues its upward movement until the mechanism is fully retracted.

The pipe rams 4 are then retracted and the stroking tool 8 is pulled into the lubricator with pulling tool 9 and plug 10.

The sequence to retrieve the lower plug would be the same as the one used for the upper plug. A stroking mandrel of different length might be used to properly space out the grabbed section in the stroking tool and the lower plug.

Operational Sequence: Installing/Setting Crown Plug

The operational sequence to install a crown plug would essentially be the same of the one used to remove a plug, but performed in different order:

The stroking tool 8 with setting tool 9 attached to it, plug 10 attached to setting tool 9, and dynamic seal is lowered into the lubricator 6. Valve/BOP 3 and 5 have been open, and pipe rams 4 have been open as well.

The toolstring is lowered into the tree and stopped in a position where the pipe rams 4 can grab the stroking tool 8 in an appropriate section.

The pipe rams 4 are activated and grab the stroking tool 8.

The stroking tool 8 is extended until the plug 10 is set in its seat. Once the plug 10 is fully set, the setting tool 9 automatically releases from the plug 10.

The stroking mechanism is reversed, moving the setting tool away from the plug.

The pipe rams 4 are retracted, releasing the stroking tool 8.

The stroking tool 8 is pulled up into the lubricator 6 with pulling tool 9.

An alternative sequence contemplated by the present disclosure, would be:

The stroking tool 8 in retracted position is lowered until plug 10 lands on top of its seating position.

The pipe rams 4 are activated and grab the stroking tool 8.

The stroking tool 8 is extended, applying a strong downwards force on plug 10, until the plug 10 is fully seated. Once the plug is fully seated, the setting tool 9 is automatically released from the plug.

The stroking tool 8 is retracted.

The pipe rams 4 are retracted and the stroking tool 8 is pulled into the lubricator with pulling tool 9.

The sequence to set the lower plug would be the same as the one used for the upper plug. A stroking mandrel of different length might be used to properly space out the grabbed section in the stroking tool and the lower plug.

While the present inventions have been described in connection with a number of exemplary embodiments, and implementations, the present inventions are not so limited, but rather cover various modifications, and equivalent arrangements, which fall within the purview of the appended claims.

What is claimed is:

1. A method for removing a plug from a subsea installation, the method comprising the steps of:

deploying an intervention package comprising at least one valve, pipe rams, and a lubricator into a subsea environment and latching the intervention package to the subsea installation;

lowering a stroking tool into the intervention package by conveyance from a surface facility;

grabbing the stroking tool with the pipe rams that form a part of the intervention package, wherein the stroking tool comprises a stroking piston capable of a linear stroking movement within a housing of the stroking tool;

once the stroking tool is held by the pipe rams, activating the stroking tool to stroke in an upwards or downwards direction to remove the plug positioned in the subsea installation; and once the plug has been removed by the stroking tool, pulling the stroking tool out of the intervention package and retrieving the stroking tool and plug at surface, wherein the stroking tool is lowered into the intervention package with the stroking piston in an extended position, and wherein prior to the step of grabbing the stroking tool with the pipe rams, the method further comprises the step of: mating the stroking tool to the plug.

2. A method for removing a plug from a subsea installation, the method comprising the steps of:

deploying an intervention package comprising at least one valve, pipe rams, and a lubricator into a subsea environment and latching the intervention package to the subsea installation;

lowering a stroking tool into the intervention package by conveyance from a surface facility;

grabbing the stroking tool with the pipe rams that form a part of the intervention package, wherein the stroking tool comprises a stroking piston capable of a linear stroking movement within a housing of the stroking tool;

once the stroking tool is held by the pipe rams, activating the stroking tool to stroke in an upwards or downwards direction to remove the plug positioned in the subsea installation; and once the plug has been removed by the stroking tool, pulling the stroking tool out of the intervention package and retrieving the stroking tool and plug at surface, wherein the stroking tool is lowered into the intervention package with the stroking piston in a retracted position, and wherein the step of activating the stroking tool in an upwards or downwards direction includes mating the stroking tool to the plug.

* * * * *